United States Patent [19]

Minsky

[11] Patent Number: 4,583,653

[45] Date of Patent: Apr. 22, 1986

[54] CONTAINER WITH LID

[75] Inventor: Norman C. Minsky, West Bend, Wis.

[73] Assignee: Dart Industries, Inc., Northbrook, Ill.

[21] Appl. No.: 752,223

[22] Filed: Jul. 3, 1985

[51] Int. Cl.[4] ..... B65D 41/06; B65D 41/36

[52] U.S. Cl. ..... 220/300; 220/293

[58] Field of Search ..... 220/290, 293, 298, 300, 220/301, 302

[56] References Cited

U.S. PATENT DOCUMENTS

| | | | |
|---|---|---|---|
| 2,008,798 | 7/1935 | Rossiter . | |
| 2,027,803 | 1/1936 | Young | 220/300 |
| 2,177,123 | 10/1939 | Wittenberg | 220/300 |
| 2,333,117 | 11/1943 | Nyden . | |
| 3,127,049 | 3/1964 | Welty et al. . | |
| 4,081,102 | 3/1978 | Sakai . | |
| 4,377,236 | 3/1983 | Montgomery . | |

*Primary Examiner*—George T. Hall

*Attorney, Agent, or Firm*—Gregory J. Mancuso

[57] ABSTRACT

A liquid container having a lid which can be selectively rotated to a secured position and to a visually distinct unsecured position, comprising a container body having a flange forming an upper opening and notches adjacent thereto, a lid adapted to engage the flange to close the opening, the lid having upper and lower tabs which can be alternatively received by the notches, the upper tabs underlying the flange to secure the lid to the container when the lid is in a first rotational position and which engage the flange to support the the lid in a visually distinct position when the lid is unsecured in a second rotational position.

21 Claims, 13 Drawing Figures

CONTAINER WITH LID

BACKGROUND OF THE INVENTION

This invention relates to a lid locking and unlocking mechanism for containers, principally household containers for liquids, as, for example, an electric water heating appliance for making tea or instant coffee. In the case of a household device for heating liquids, or for holding hot liquids, it is generally advisable to provide a lid which can be secured in place to minimize the risk of inadvertent spills. Most conventional containers utilize a screw top, a snap top, or a friction fit top. It is also advisable to construct the container so that when the lid is unsecured on the container that fact is obvious at even a casual glance. Most conventional containers do not provide any such visual indicia of unsecured status. In the case of screw-top containers, for example, the secured and unsecured positions of the lid may differ only in rotational position on the container. Snap top and friction fit tops tend to be even more ambiguous as to status. What has been needed, but not provided by the prior art, is a container having a lid which can be selectively rotated to a secured position and to a visually distinct unsecured position.

SUMMARY OF THE INVENTION

In the container of this invention, the lid can be rotated to a first position in which it is tightly secured to the container body, to a second position in which it is loosely secured to the container body, and to a third unsecured position in which the lid is raised to a visually distinct position above the container body. The container is provided with an upper wall defining a generally circular opening for introducing liquids into the container. Around the perimeter of the opening are two notches. The lid has a shoulder adapted to engage the upper wall when the lid is in a secured position on the container body, and a skirt adapted to be received by the opening. Around the perimeter of the skirt are two upper tabs. Adjacent to each upper tab is a lower tab, at a greater distance from the shoulder than the upper tabs. The upper and lower tabs are adapted to be received by the notches. In the secured position, the lid substantially covers the opening and engages the upper wall. The upper tabs engage or closely underlie the upper wall, to prevent substantial movement of the lid away from the container body. The lid can be rotated to a second position, in which the upper tabs are aligned with the notches. In the second position, the lower tabs underlie, and are spaced from, the upper wall. In the second position, the lid is loosely secured in place, its movement away from the container body limited by the interaction of the lower tabs and the upper wall. The lid can be raised and rotated to a third position, in which the upper tabs engage the upper wall. The upper tabs can be adapted to support the lid so that the shoulder is raised above and generally parallel to the upper wall. Alternatively, the upper tabs can be adapted to support the lid in an offset position in which a portion of the lid engages the container body. In the offset position, the shoulder is in a non-parallel relationship to the upper wall and is substantially out of contact with the upper wall. In either case, the third position is sufficiently distinct from the first and second positions that it is evident even upon casual observation that the lid is unsecured.

The lid can also be supported in an elevated position in a fourth rotational position, in which the lower tabs engage the upper wall. In the fourth position, the lid is supported by the lower tabs and by a portion of the lid in contact with the container body.

To facilitate operation of the lid and container assembly, an arm and slot can be provided. The arm projects from the skirt and is received by a slot in the upper wall. The arm functions to further secure the lid in the second rotational position and to support the lid in a fifth position. The arm underlies the upper wall when the lid is in the first and second rotational positions. In the third rotational position, the arm is aligned with the slot. In the fourth rotational position, the arm underlies the upper wall. In the fifth rotational position, the upper tabs and the arm engage the upper wall to raise the lid and to support the shoulder out of contact with the upper wall. In the preferred embodiment, the arm comprises a first projection substantially similar to the lower tabs, at approximately the same distance from the shoulder. The arm also comprises a second projection between the first projection and the bottom of the skirt.

In the preferred embodiment, the notches and the slot are equally sized cut-outs in the perimeter of the upper wall, spaced equally about the perimeter. All three cut-outs will accept the lower tabs, the upper tabs, and the arm. In this manner, the lid can be secured in place in any one of three orientations.

From the above summary, and the following description of preferred embodiments, it is seen that this invention provides a lid and container combination in which in all unsecured positions the lid orientation provides clear notice of its unsecured status.

DRAWINGS

Figure 3:
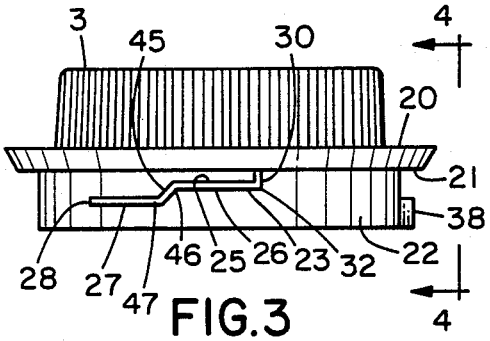
FIG. 3 shows a side elevational view of the lid of the ıer of FIG. 1.
Figure 4:
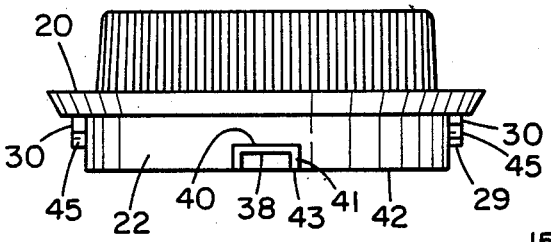

4 shows an elevational view of the lid of FIG. 3, on line 4—4.

Figure 1:
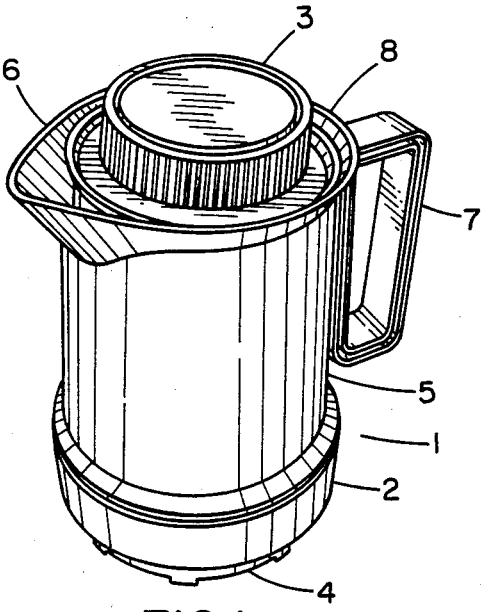
FIG. 1 shows, in side perspective, an example of a container of the type to which this invention is adapted.
Figure 5:
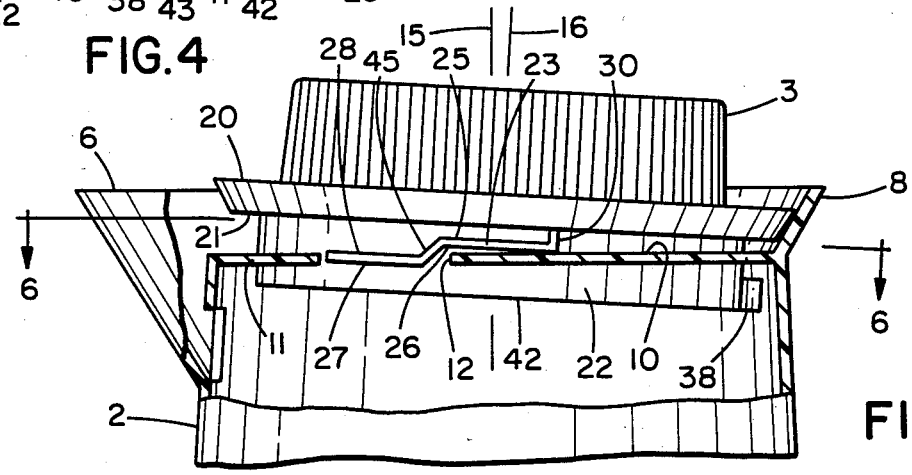

FIG. 5 shows a partial elevational view, in partial cutaway, of the container of FIG. 1 with the lid in a first unsecured position.

Figure 6:
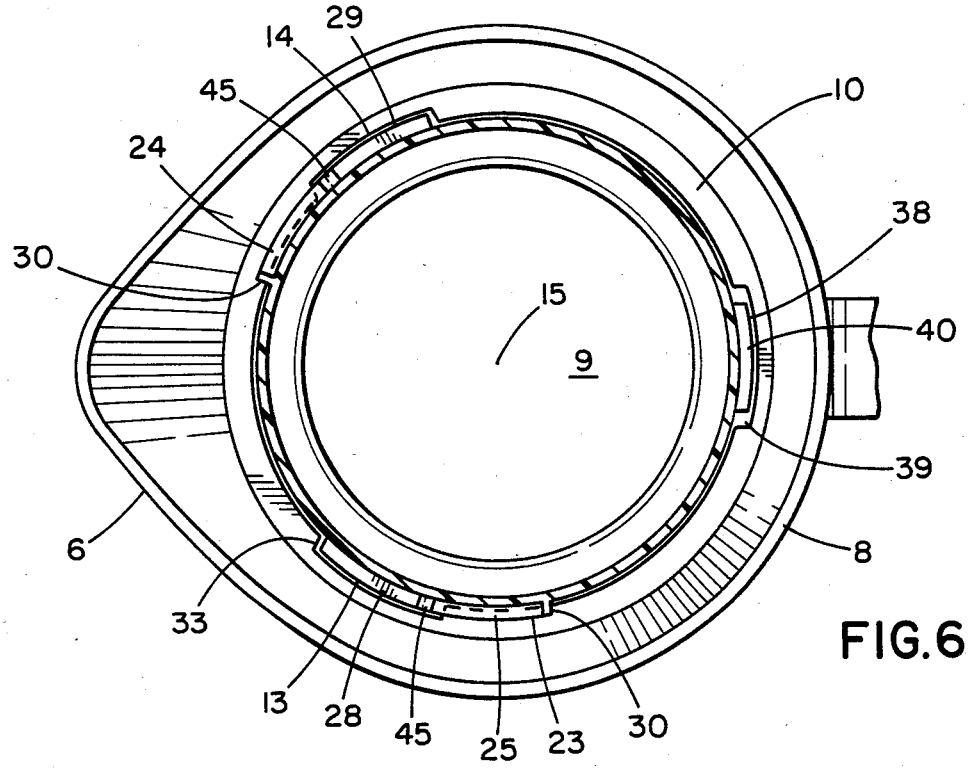

FIG. 6 shows a section view of the container of FIG. 5, taken on line 6—6.

Figure 7:
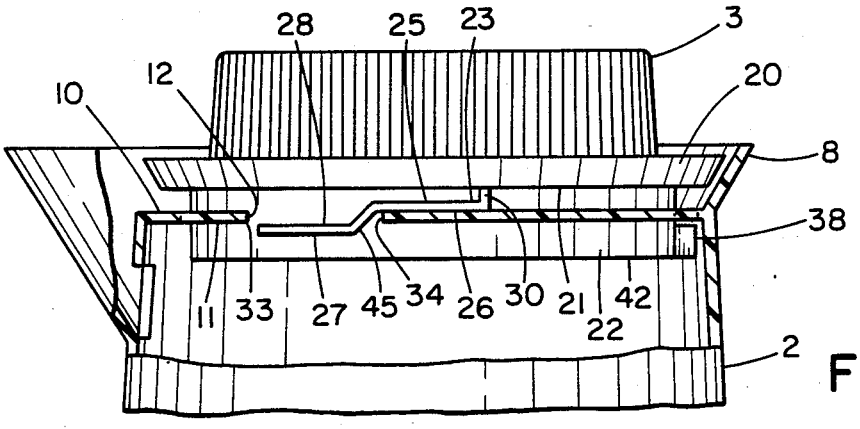

FIG. 7 shows a partial elevational view, in partial cutaway, of the container of FIG. 1 with the lid in a second unsecured position.

Figure 8:
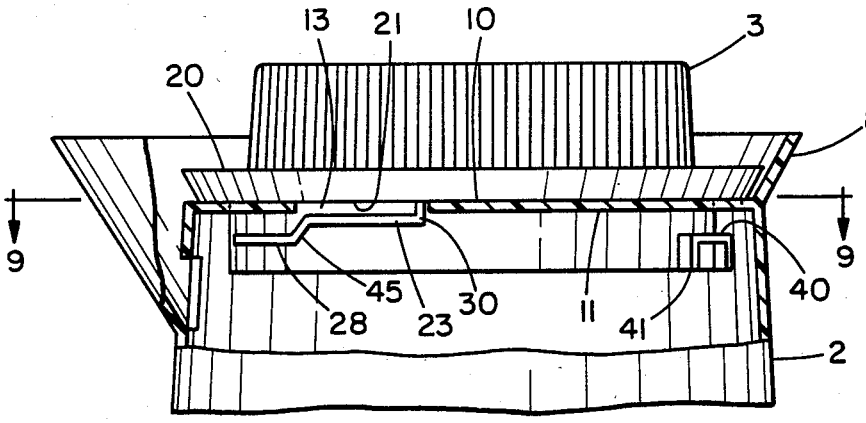

FIG. 8 shows a partial elevational view, in partial cutaway, of the container of FIG. 1 with the lid in a loosely secured position.

Figure 9:
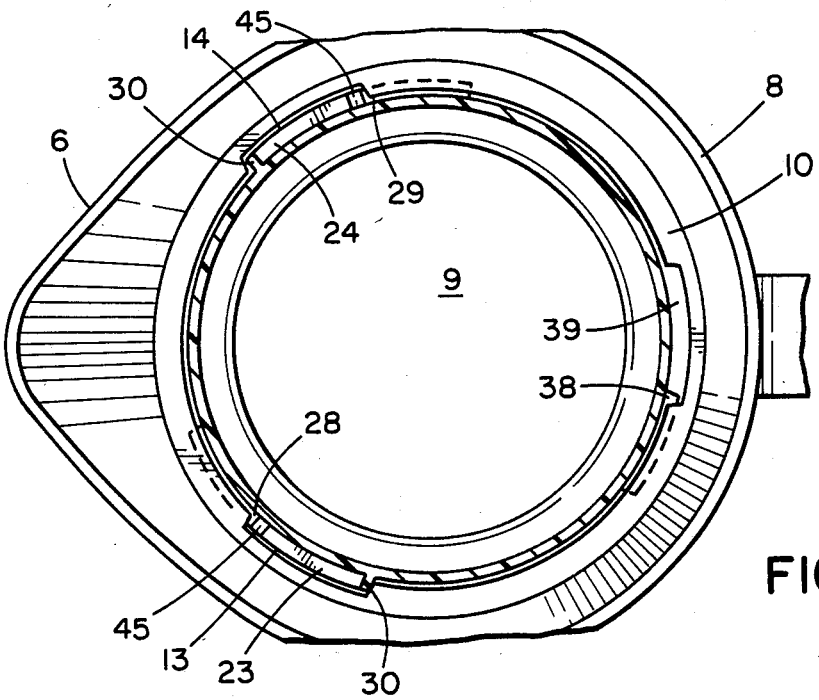

FIG. 9 shows a section view of the container of FIG. 8, taken on line 9—9.

Figure 10:
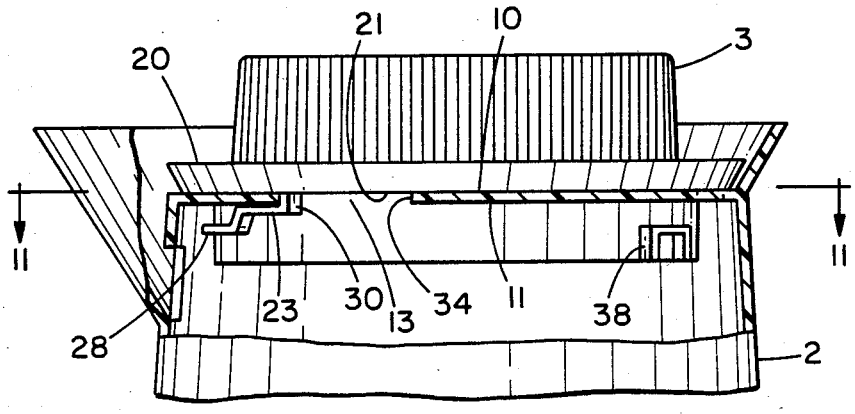

FIG. 10 shows a partial elevational view, in partial cutaway, of the container of FIG. 1 with the lid in a tightly secured position.

Figure 11:
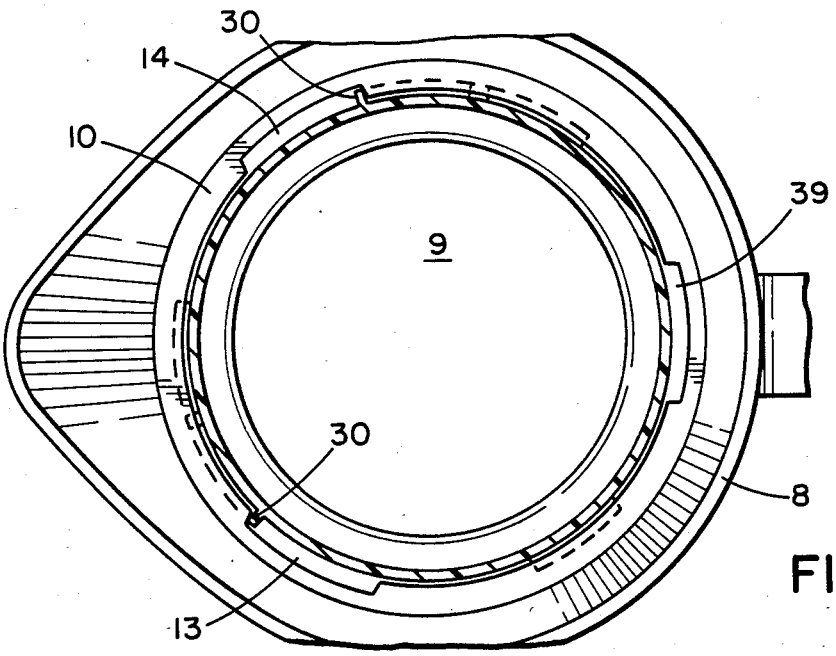

FIG. 11 shows a section view of the container of FIG. 10, taken on line 11—11.

Figure 12:
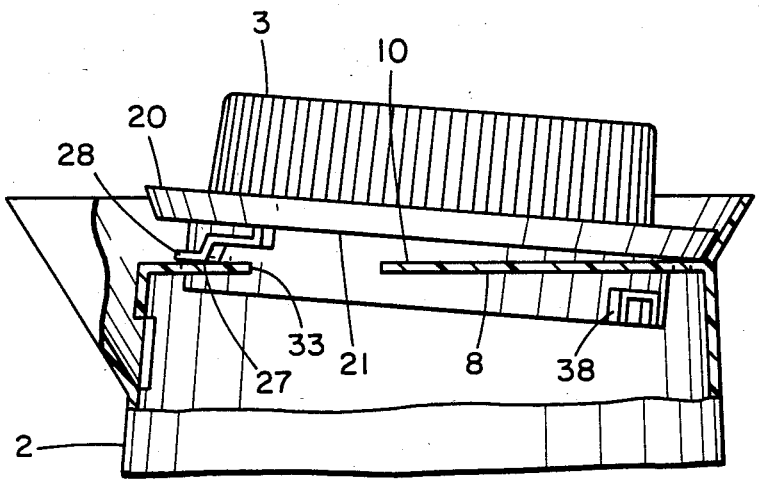

FIG. 12 shows a partial elevational view, in partial cutaway, of the container of FIG. 1 with the lid in a third unsecured position.

Figure 13:
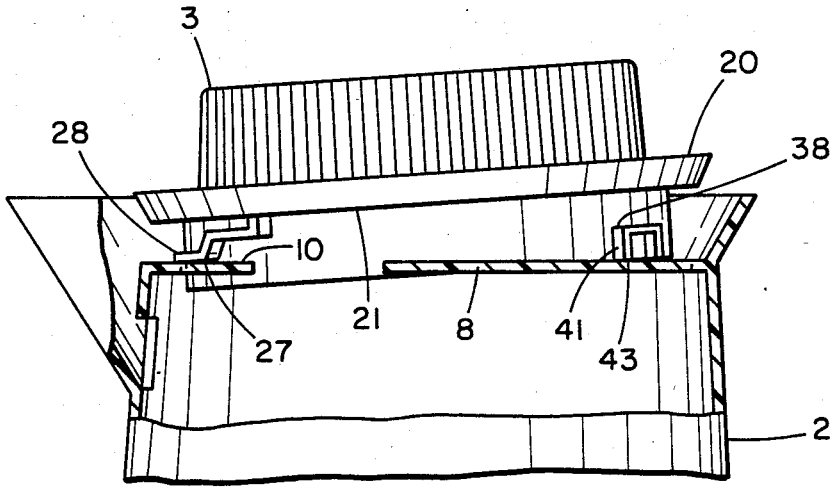

FIG. 13 shows a partial elevational view, in partial cutaway, of the container of FIG. 1 with the lid in a fourth unsecured position.

DETAILED DESCRIPTION OF PREFERRED EMBODIMENT

The container of this invention is exemplified by the container 1 shown in FIG. 1. Container 1 comprises body 2 and lid 3. Body 2 and lid 3 may be made of any conventional materials. It is preferred that body 2 and lid 3 be made substantially completely of thermoplastic. Body 2 comprises base 4, upstanding sides 5, pour spout 6, and handle 7. Referring to FIGS. 2–13, body 2 is provided with upper wall 8 defining generally circular opening 9 for introducing liquids into the container. Upper wall 8 has generally planar annular upper face 10, a generally parallel lower face 11, and a lateral face 12 generally perpendicular to upper face 10, defining a first notch 13 and a second notch 14 in upper wall 8. It is preferred that notches 13,14 comprise indentations in lateral face 12 forming lateral cut-outs in upper wall 8. Notches 13,14 can also comprise indentations or slots in upper face 10. Lid 3 comprises flange 20 having generally planar shoulder 21 adapted to engage upper face 10 when lid 3 is secured to body 2, to substantially cover opening 9. It is preferred that shoulder 21 and upper face 10 mate to form a generally liquid tight seal.

Lid 3 also comprises generally cylindrical skirt 22 extending generally perpendicularly to shoulder 21, adapted to be received by opening 9. It is preferred that skirt 22 have a diameter of about 90% to about 98% the diameter of opening 9 so that skirt 22 is received closely by opening 9 without binding. Skirt 22 has a height sufficient to extend into opening 9 in substantially all positions of lid 3 on body 2 over opening 9. Skirt 22 serves to help locate lid 3 on body 2, and to reduce heat transfer between the contents of container 1 and the atmosphere. Lid 3 also carries first upper tab 23 and second upper tab 24 which are adapted to be received by first and second notches 13,14. It is preferred that upper tabs 23,24 comprise elongated projections carried by skirt 22 generally perpendicular thereto, and generally parallel to shoulder 21, and that their dimensions be such that they substantially fully occupy notches 13,14 when received thereby. In that manner, upper tabs 23,24 may be easily introduced into notches 13,14 and, when resident in notches 13,14, the interference of upper tabs 23,24 with notches 13,14 prevents substantial rotation of lid 3. Upper tabs 23,24 have top bearing surfaces 25,26, respectively, spaced from shoulder 21 a distance slightly greater than the thickness of upper wall 8 measured as the distance between upper face 10 and lower face 11.

Lid 3 also carries first lower tab 28 and second lower tab 29 which are adapted to be received by first and second notches 13,14. It is preferred that lower tabs 28,29 comprise elongated projections similar to upper tabs 23,24, carried by skirt 22 and generally perpendicular thereto, adjacent to upper tabs 23,24, and generally parallel to shoulder 21. It is also preferred that the dimensions of lower tabs 28,29 be such that they substantially fully occupy notches 13,14 when received thereby. In that manner, lower tabs 28,29 may be easily introduced into notches 13,14 and, when resident in notches 13,14, the interference of lower tabs 28,29 with notches 13,14 prevents substantial rotation of lid 3.

Opening 9 has an opening axis 15 generally perpendicular to upper face 10. Lid 3 has a lid axis 16 common to opening axis 15 when shoulder 21 is fully engaged with upper face 10, and is adapted to rotated about common opening axis 15 and lid axis 16 between a first rotational position and a second rotational position. In the first rotational position of lid 3 on body 2, illustrated in FIGS. 10 and 11, shoulder 21 engages upper face 10, substantially closing opening 9. In that position, upper tabs 23,24 underlie upper wall 8. It is preferred that top bearing surfaces 25,26 slidingly engage lower face 11. Top bearing surfaces 25,26 can alternatively be closely spaced from lower face 11, without engagement. In a third alternative, upper tabs 23,24 can be slightly non-parallel with shoulder 21, so that a greater distance exists between shoulder 21 and proximate ends 46 of upper tabs 23,24 than between shoulder 21 and distal ends 32 of upper tabs 23,24. If the distance between shoulder 21 and distal ends 32 is the same or less than the thickness of upper wall 8, an interference fit can be accomplished when lid 3 is fully rotated into its first rotational position.

In the first rotational position, the interference of upper tabs 23,24 and upper wall 8 limits the movement of lid 3 away from body 2 along axis 15. It is also preferred that a first stop tab 30 be provided to limit the rotational movement of lid 3 on body 2. It is further preferred that first stop tab 30 comprises a projection on skirt 22 generally perpendicular thereto, proximate one of the distal ends 32 of one of upper tabs 23,24. It is most preferred that two first stop tabs 30 be provided, each extending between shoulder 21 and top bearing surfaces 25,26 adjacent distal ends 32 of each of upper tabs 23,24. When lid 3 is completely turned into its first rotational position, upper tabs 23,24 substantially completely underlie upper wall 8 and first stop tabs 30 engage front surfaces 33 of first and second notches 13,14.

Lid 3 can be rotated about opening axis 15 and lid axis 16 to a second rotational position in which upper tabs 23,24 are aligned with first and second notches 13,14, illustrated in FIGS. 8 and 9, and shoulder 21 engages upper face 10. In the second rotational position, lower tabs 28,29 underlie upper wall 8, to prevent removal of lid 3 along axis 15. Lower tabs 28,29 are spaced at a greater distance from shoulder 21 than upper tabs 23,24, [illegible]w some movement of lid 3 along axis 15. It is [illegible]ed that lower tabs 28,29 be located at a distance [illegible]oulder 21 no greater than necessary to allow lid 3 to be moved axially in its second rotational position sufficiently to elevate bottom bearing surface 26 above upper face 10, to allow lid 3 to be rotated into its third rotational position. It is also preferred that lower tabs 28,29 be adjacent to upper tabs 23,24, at generally corresponding circumferential positions on skirt 22. In the preferred embodiment, lid 3 cannot be removed from body 2 along axis 15 while lid 3 is in its second rotational position. When lid 3 is completely turned into its second rotational position, lower tabs 28,29 substantially completely underlie upper wall 8 and first stop tabs 30 engage back surfaces 34 of first and second notches 13,14.

When lid 3 is raised sufficiently that bottom bearing surfaces 26 of upper tabs 23,24 are above upper face 10, lid 3 can be rotated from its second rotational position to its unsecured third rotational position. FIGS. 5 and 6 illustrate the preferred third rotational position. In that position, shoulder 21 is not parallel with upper face 10 and lid axis 16 is at an angle to opening axis 15. In that position, upper tabs 23,24 are supported by upper wall 8 by the engagement of bottom bearing surfaces 26 with upper face 10. Upper tabs 23,24 are located such that when lid 5 is supported by upper tabs 23,24, lid 5 is unbalanced and consequently tends to tilt in one direction. In the preferred embodiment of this invention, the lid is generally circular and symmetrical in top and bottom plan, and upper tabs 23,24 are both located on the same side of a centerline. Lid 5 is also supported by the engagement of flange 20 with upper wall 8. Because of the non-parallel relationship of shoulder 21 and upper face 10, and because lid axis 16 is offset from opening axis 15, the unsecured third rotational position of lid 3 is visually distinct from the secured first and second rotational positions.

FIG. 7 shows an alternative third rotational position. In that position, upper tabs 23,24 support lid 3 such that shoulder 21 is generally parallel to upper face 10 and opening axis 15 and lid axis 16 are co-axial.

When lid 3 is removed from body 2 and thereafter returned, lower tabs 28,29 may or may not be received by first and second notches 13,14, depending on whether lower tabs 28,29 are aligned with first and second notches 13,14 when lid 3 is placed on body 2. If notches 13,14 receive lower tabs 28,29, lid 3 will be supported in its third rotational position described above. Container 1 is adapted to support lid 3 in an unsecured fourth rotational position, illustrated in FIG. 12. In that position, support surfaces 27 of lower tabs 28,29 and flange 20 engage upper wall 8 to support lid 3 is an offset position in which shoulder 21 is in a non-parallel relationship to upper face 10. In the fourth rotational position, as in other rotational positions, skirt 22 extends into opening 9.

Figure 2:
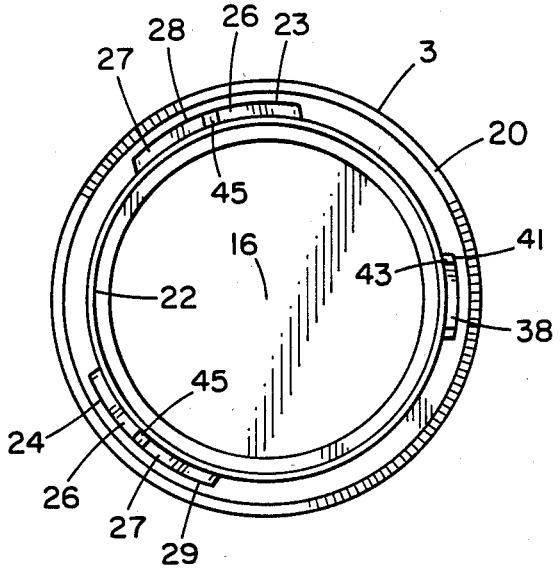
FIG. 2 shows a bottom plan view of the underside of the lid of the container in FIG. 1, and also a top plan view of the container body shown in FIG. 1, with the lid removed.
Figure 2:
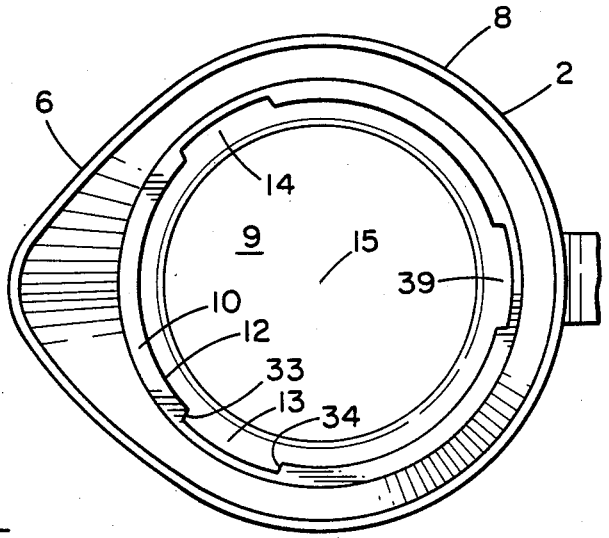

To facilitate the operation of the container of this invention, it is preferred that lid 3 be provided with an arm 38 and that upper wall 8 be provided with a corresponding slot 39 adapted to received arm 38. One purpose of arm 38 is to ensure that lid 3 cannot be removed from body 2 while lid 3 is in the first and second rotational positions. In the preferred embodiment, arm 38 projects from skirt 22 and comprises a lateral member 40 of generally the same dimensions as lower tabs 28,29, generally parallel to shoulder 21 and spaced from shoulder 21 at approximately the same distance as lower tabs 28,29. Arm 38 also comprises leg 41 between lateral member 40 and lower edge 42 of skirt 22. Also in the preferred embodiment, slot 39 comprises an opening in upper wall 8 substantially identical to first and second notches 13,14. It is preferred that first and second notches 13,14 and slot 39 be spaced at equal distances about the perimeter of upper wall 8, as illustrated in FIG. 2. It is also preferred that lower tabs 28,29 and arm 38 be spaced at equal distances about the perimeter of skirt 22, also as illustrated in FIG. 2. In that manner, each of first and second notches 13,14 and slot 39 can receive lower tabs 28,29 and arm 38, and lid 3 can be introduced onto body 2 in the third rotational position in any one of three orientations of lid 3 about opening axis 15.

In the first rotational position, arm 38 and lower tabs 28,29 underlie upper wall 8 at a distance, and upper tabs 23,24 secure lid 3 from substantial movement along opening axis 15. In the second rotational position, each of upper tabs 23,24 aligns with one of first and second notches 13,14 and slot 39, as illustrated in FIG. 10. In that position, arm 38 and lower tabs 28,29 underlie upper wall 8, as illustrated in FIG. 8, and prevent removal of lid 3 from body 2 by interfering with upper wall 8 as lid 3 is moved axially. In the third rotational position, illustrated in FIGS. 5 and 6, upper tabs 23,24 rest on upper wall 8 and each of lower tabs 28,29 and arm 38 underlies one of first and second notches 13,14 and slot 39. In the fourth rotational position, illustrated in FIG. 12, arm 38 underlies upper wall 8 and lower tabs 28,29 and flange 20 rest on upper wall 8.

Arm 38 enables lid 3 to assume a fifth rotational position, illustrated in FIG. 13. That position is similar to the fourth rotational position, except that arm 38 overlies upper wall 8 rather than underlies it. In the fifth rotational position, lid 3 is supported by the engagement of lower tabs 28,29 and leg 41 with upper wall 8. Underside 43 of leg 41 is located at a greater distance from shoulder 21 than the support surfaces 27 of lower tabs 28,29. Consequently, in the fifth rotational position shoulder 21 is in a non-parallel relationship to upper face 10.

In the preferred embodiment of this invention, second stop tabs 45 connect proximate end 46 of at least one of upper tabs 23,24 and adjacent end 47 of the corresponding lower tab 28 or 29. Second stop tabs 45 serve to facilitate the movement of lid 3 between the second, third and fourth rotational positions. As lid 3 is rotated from its second rotational position to its third rotational position, second stop tabs 45 engage back surfaces 34 to align lower tabs 28,29 with first and second notches 13,14. As lid 3 is further rotated in the same direction toward the fourth rotational position, second stop tabs 45 direct lower tabs 28,29 out of first and second notches 13,14 and onto upper wall 8. In a similar manner, when lid 3 is rotated in a reverse direction from its third rotational position, second stop tabs 45 engage front surfaces 33 to direct upper tabs 23,24 into first and second notches 13,14.

From the foregoing it is seen that in all unsecured positions of lid 3 on body 2—ie., in all positions of lid 3 on body 2 in which lower tabs 28,29 do not underlie upper wall 8—lid 3 is supported in an elevated position visually distinct from the positions in which lid 3 is secured to body 2. As is obvious from the foregoing, many alternative embodiments fall within the scope and intent of this invention. The following claims are intended to fully include all such embodiments.

I claim:

1. A container having a lid which can be selectively rotated to a secured position and to a visually distinct unsecured position, comprising:

a container body having an upper wall forming a generally circular opening in said body for introducing material into said body, said upper wall having an upper face and a lower face, and having a lateral face forming a first notch and a second notch in said upper wall, a flange on said lid having a shoulder adapted to engage said upper face when said lid is in a first rotational position and in a second rotational position with respect to said body, said lid adapted to substantially cover said opening in said first rotational position, a skirt proximate said shoulder extending downwardly from said lid, adapted to be received by said opening proximate said lateral face when said lid is in said first rotational position, first and second upper tabs projecting from said skirt proximate said shoulder adapted to be received by said first and second notches, respectively, said first and second upper tabs having top bearing surfaces adapted to reside adjacent to said lower face when said lid is in said first rotational position and having bottom bearing surfaces adapted to engage said upper face to support substantially all of said shoulder out of contact with said upper face when said lid is in a third rotational position, said first and second upper tabs adapted to be aligned with said first and second notches, respectively, when said lid is in said second rotational position intermediate said first rotational position and said third rotational position, and first and second lower tabs projecting from said skirt adjacent to said first and second upper tabs, respectively, more distant from said shoulder than said first and second upper tabs, adapted to be received by said first and second notches, respectively, said first and second lower tabs adapted to be aligned with said first and second notches, respectively, when said lid is in said third rotational position, and adapted to underlie said lower face when said lid is in said second rotational position, whereby said lid is secured in place by said first and second tabs when said lid is in said first rotational position, said lid is loosely held in place by said first and second lower tabs when said lid is in said second rotational position, and said lid is unsecured and supported above said upper wall by said first and second tabs when said lid is in said third rotational position.

2. The container of claim 1 wherein said first and second upper tabs are adapted to engage said upper wall to support said shoulder out of contact with and generally parallel to said upper face when said lid is in said third rotational position.

3. The container of claim 1 wherein said first and second upper tabs and said flange are adapted to engage said upper wall to support said shoulder in a non-parallel relationship to said upper face when said lid is in said third rotational position.

4. The container of claim 3 wherein said first and second lower tabs and said flange are adapted to engage said upper wall to support said shoulder in a non-parallel relationship to said upper face when said lid is in a fourth rotational position in which said first and second lower tabs are out of alignment with said first and second notches.

5. The container of claim 4 wherein an arm projects from said skirt and said lateral face forms a slot in said upper wall adapted to receive said arm, said arm adapted to underlie said lower face when said lid is in said second rotational position, and adapted to be aligned with said slot when said lid is in said third rotational position.

6. The container of claim 5 wherein said arm has a bottom edge, and said bottom edge and said first and second lower tabs are adapted to engage said upper wall to support said shoulder out of contact with said upper face when said lid is in a fifth rotational position.

7. The container of claim 6 wherein said lateral face forming said first notch has a front surface and a back surface and said sidewall carries a first stop tab intermediate said first upper tab and said first lower tab adapted to engage said back surface when said lid is in said third rotational position.

8. The container of claim 7 wherein said first upper tab and said first lower tab have proximate ends and said first stop tab connects said proximate ends.

9. The container of claim 8 wherein a second stop tab projects from said skirt intermediate said shoulder and said first upper tab, adapted to engage said front surface when said lid is in said first rotational position and to engage said back surface when said lid is in said second rotational position, whereby the rotational movement of said lid is restricted when said shoulder is engaged with said upper face.

10. The container of claim 9 wherein said first upper tab has a distal end and said second stop tab is adjacent to said distal end.

11. A household container for liquids such as hot water and the like, adapted to hold a lid in a secured position and in a visually distinct unsecured position, comprising:

a container body comprising a base, upstanding sides, and an upper wall defining a generally circular opening for introducing liquid into said body, said opening having an opening axis, said upper wall having an upper face and a lower face and having lateral faces defining a pair of notches, a lid adapted to substantially cover said opening and to rotate about said opening axis between a first position and a second position with respect to said body, said lid having a shoulder adapted to engage said upper face in a generally sealing relationship when said lid is in said first position and said second position, a pair of upper tabs carried by said lid, adapted to be received by said pair of notches, adapted to be aligned with said pair of notches when said lid is in said second position and adapted to closely underlie said upper wall when said lid is in said first position to prevent substantial movement of said lid along said opening axis, a pair of lower tabs carried by said lid, adjacent to, and more distant from said shoulder than, said pair of upper tabs, said pair of lower tabs adapted to be received by said pair of notches, adapted to be aligned with said pair of notches when said lid is in a third position, and adapted to underlie said upper wall when said lid is in said second position, bottom bearing surfaces on said pair of upper tabs adapted to engage said upper face to support substantially all of said shoulder out of contact with said upper face when said lid is in said third position, whereby said lid is secured from substantial axial movement when said lid is in said first position, said lid is limited in axial movement when said lid is in said second position, and said lid is unsecured and supported above said upper wall in said third position.

12. The container of claim 11 wherein said pair of upper tabs are adapted to engage said upper wall to support said lid on said opening axis.

13. The container of claim 11 wherein said pair of upper tabs and said flange are adapted to engage said upper wall to support said lid on a first offset axis at an angle to said opening axis.

14. The container of claim 11 wherein said pair of lower tabs and said flange are adapted to engage said upper wall to support said lid on a second offset axis at an angle to said opening axis when said lid is in a fourth position.

15. The container of claim 14 wherein said lid carries an arm and said upper wall defines a slot adapted to receive said arm, said arm adapted to underlie said upper wall when said lid is in said second position, adapted to be aligned with said slot when said lid is in said third position, and adapted to cooperate with said pair of lower tabs and to engage said upper face simultaneously therewith to support said lid in a fourth position in which said shoulder is out of contact with said upper face.

16. The container of claim 15 wherein in said fourth position said lid is on a third offset axis at an angle from said opening axis.

17. The container of claim 16 wherein one of said lateral faces has a front surface and a back surface and said lid carries a first stop tab adapted to engage said back surface when said lid is in said third position.

18. The container of claim 17 wherein said lid carries a second tab stop adapted to engage said front surface when said lid is in said first position and to engage said back surface when said lid is in said second position, whereby rotational movement of said lid is restricted when said shoulder is engaged with said upper face.

19. A household container for liquids adapted to hold a lid in a secured position and in a visually distinct unsecured position, comprising:

a container body comprising a base, upstanding sides, and an upper wall having a generally planar upper face and an opposed lower face and having a lateral face forming a generally circular opening with a pair of notches in the perimeter of said opening, a lid having a flange having a generally planar shoulder adapted to matingly engage said upper face, and having a generally cylindrical skirt having a pair of sidewalls and a rear wall, said skirt adapted to be received by said opening in a first and second rotational position of said lid with respect to said body in which said shoulder is engaged with said upper face and in a third rotational position of said lid in which said shoulder is out of mating engagement with said upper face and in a non-parallel relationship to said upper face, an upper tab on each of said sidewalls, spaced from said shoulder, adapted to closely underlie said lower face in said first rotational position, and adapted to align with said pair of notches in said second rotational position, said upper tabs adapted to engage said upper face, and said flange proximate said rear wall adapted to engage said upper wall, to support said lid in said third rotational position, a lower tab on each of said sidewalls, adjacent to, and more distant from said shoulder than, said upper tabs, adapted to underlie said lower face in said first and second rotational positions and adapted to align with said pair of notches in said third rotational position, and an arm on said sidewall proximate said rear wall, adapted to be received by a slot in said upper wall, said arm adapted to underlie said upper wall in spaced relation therefrom in said first and second rotational positions and adapted to align with said slot notch in said third rotational position.

20. The container of claim 19 wherein one of said sidewalls bears a first stop tab adjacent to said upper tab adapted to limit rotational movement of said lid when said shoulder is in engagement with said upper face, and one of said sidewalls bears a second stop tab intermediate said upper tab and said lower tab adapted to limit rotational movement of said lid when said lid is supported by said upper tabs in engagement with said upper face.

21. The container of claim 20 wherein said arm has a bottom edge, and said bottom edge and said lower tabs are adapted to engage said upper wall to support said shoulder out of contact with said upper face when said lid is in a fourth rotational position.

* * * * *